United States Patent [19]

Huggett

[11] 4,070,816

[45] Jan. 31, 1978

[54] YARN MANUFACTURING

[75] Inventor: Ralph Huggett, Rochdale, England

[73] Assignee: TBA Industrial Products Limited, Manchester, England

[21] Appl. No.: 744,440

[22] Filed: Nov. 23, 1976

Related U.S. Application Data

[63] Continuation-in-part of Ser. No. 510,723, Sept. 30, 1974, abandoned, and Ser. No. 663,751, March 4, 1976, abandoned.

[51] Int. Cl.[2] ..... D02G 3/20

[52] U.S. Cl. ..... 57/153; 57/164; 264/103; 264/183

[58] Field of Search ..... 57/140 R, 153, 156, 57/157 R, 164; 28/76 R; 19/66 R; 264/103, 183, 184

[56] References Cited

U.S. PATENT DOCUMENTS

| | | | |
|---|---|---|---|
| 3,452,532 | 7/1969 | Welke et al. | 57/164 X |
| 3,453,818 | 7/1969 | Novak et al. | 57/164 |
| 3,738,805 | 6/1973 | Fetzer | 57/156 X |
| 3,759,027 | 9/1973 | Barnett | 57/153 X |
| 3,943,220 | 3/1976 | Barnett et al. | 57/164 X |

*Primary Examiner*—Richard C. Queisser
*Assistant Examiner*—Charles Gorenstein
*Attorney, Agent, or Firm*—Diller, Brown, Ramik & Wight

[57] ABSTRACT

A process for making a dispersion-based asbestos strand for later twisting to form a yarn comprises (a) forming an elongate continuous stream from an aqueous coagulable dispersion comprised of asbestos fibres, water and dispersion-forming chemicals; (b) coagulating said dispersion in said stream to form a self-sustaining asbestos fibre strand containing coagulated dispersion-forming chemicals together with uncoagulated residues thereof and water; (c) while said strand is in an untwisted state removing substantially the whole of the coagulated dispersion-forming chemicals and said uncoagulated residues thereof; and (d) adjusting the water content of the strand to provide an untwisted strand formed substantially wholly of said asbestos fibres and containing not more than 20% by weight of water.

9 Claims, 2 Drawing Figures

YARN MANUFACTURING

Figure 1:
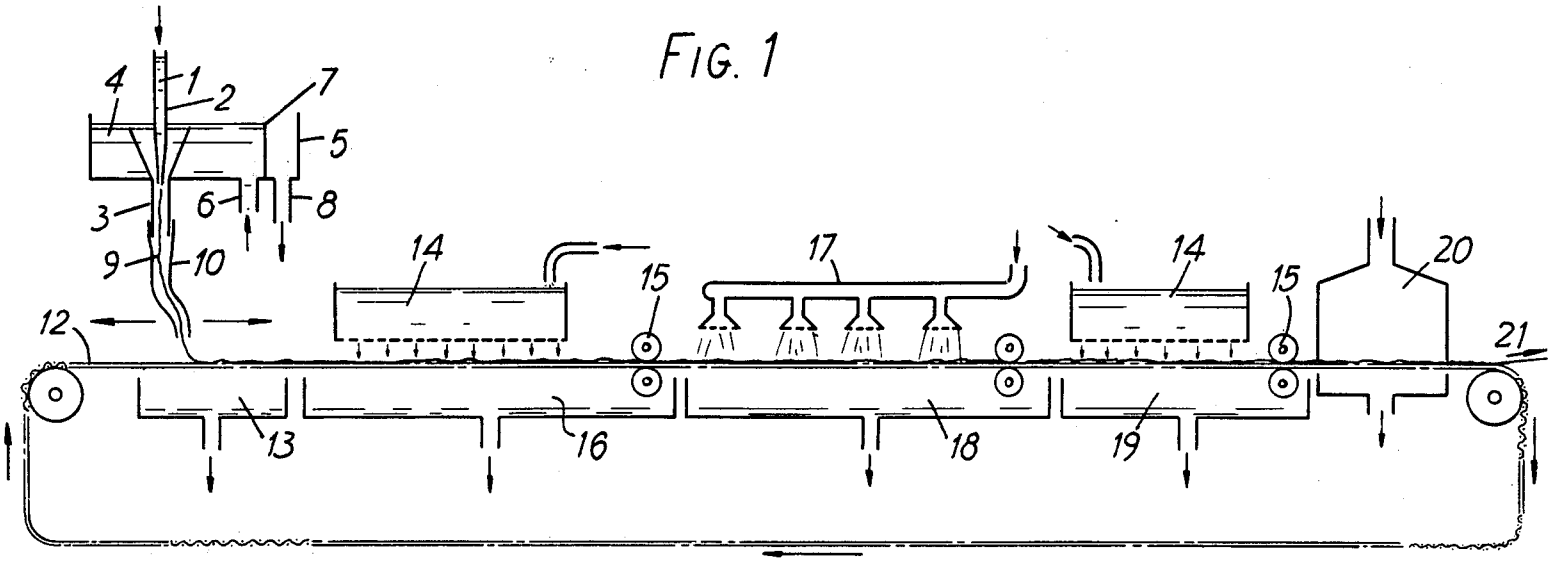

This application is a continuation-in-part of my earlier application Ser. No. 510,723, filed Sept. 30, 1974, and its continuation Ser. No. 663,751, filed Mar. 4, 1976, now both abandoned.

This invention relates to the manufacture of asbestos yarns from dispersions of asbestos fibre by a process such as that described in U.K. Pat. No. 824,446. Common to processes of the kind described in this latter specification are the steps of forming a coagulable dispersion of asbestos in water using at least one surfactant and/or soap as dispersion-forming chemicals, forming an elongate stream (or streams) of said dispersion and thereafter coagulating the dispersion in the stream (or streams), for example, by contact with a coagulant solution to form a self-sustaining strand (or strands), collecting said strand (or strands) and twisting it (or them) into a yarn, optionally followed by extracting the coagulated dispersion-forming chemicals and uncoagulated residues thereof to leave a yarn comprised wholly of asbestos. It is normal also to reduce the water content of the strand (or strands) to facilitate twisting on conventional spinning frames. For most practical purposes, the extraction step is usually considered to be not just optional, but highly desirable and even essential to the process. Yarns made by such a process will be referred to as dispersion-based yarns in this specification.

In general, dispersion-based yarns are smoother, lighter and stronger than equivalent yarns made by conventional carding and spinning processes. However, they tend to be stiffer than conventional yarns (lacking the flexibility of the latter). It is well known that a yarn made up from a number of filaments is much more flexible than a monofilament yarn of equivalent size. Accordingly, one way of increasing the flexibility of a dispersion-based yarn is to make a number of fine yarns and after extracting the coagulated dispersion-forming chemicals and uncoagulated residues thereof from these fine yarns, to twist them together into a single folded yarn. This requires not only an extra twisting or spinning operation, but also the ability to produce suitably fine yarns.

A solution which would eliminate the extra processing step is to form the dispersion into a number of fine streams which after coagulating the dispersion therein are collected together and then twisted into a single yarn before extracting the dispersion-forming chemicals and uncoagulated residues thereof. This does not, however, impart the desired flexibility to the final yarn because the wet fine strands containing coagulated dispersion-forming chemicals and uncoagulated residues thereof tend to stick together, becoming tightly bound in the twisting process and subsequent removal of the chemicals does not then give a yarn of significantly greater flexibility.

According to the present invention, a dispersion-based asbestos yarn is made by a process including the steps of removing substantially the whole of the coagulated dispersion forming chemicals and uncoagulated residues thereof from the strand and then adjusting the water content of the strand to not more than 20% by weight prior to twisting the strand to form a yarn. For convenience, the "coagulated dispersion-forming chemicals and uncoagulated residues thereof" will be referred to simply as "residual processing chemicals" throughout the rest of this specification.

Where it is desired to make a yarn of greater linear density, advantageously at least two and preferably ten or more strands are subjected to the extraction and water content adjustment steps just referred to prior to twisting the strands together into a yarn. It has been found that removal of the residual processing chemicals and drying prior to the insertion of any twist results in a yarn in which the component strands retain their identity and are not tightly bound together, so that the yarn is both softer and more bulky than a yarn made from a single coarse strand.

Even where the process of the invention is applied only to a single strand there is an improvement in the flexibility of the finished yarn when compared to a yarn produced from the strand by a conventional process in which the residual processing chemicals are extracted after the insertion of twist.

The extraction of the residual processing chemicals is also extremely beneficial in reducing corrosion of the conventional textile winding and twisting machinery used; hitherto this has been a very serious practical problem in the manufacture of dispersion-based asbestos yarns.

Although strands may be made individually, collected, extracted and stored prior to twisting them together into a single yarn, it is difficult to ensure that they are for practical purposes identical as regards their properties. It is therefore preferred that all the strands which are eventually to be twisted into a single yarn are formed together and processed together under exactly the same conditions right up to the twisting operation. This may with advantage be accomplished by using a single, multiple nozzle extrusion heat, each nozzle being supplied with dispersion from a common supply reservoir fed by a metering pump so as to produce a number of identical or very nearly identical filaments.

The number of nozzles employed to make a given yarn will depend on the yarn nature of the product desired. For a medium weight yarn in the range 500–1000 tex, the number of nozzles will be of the order of from 20 to 50. A further factor is that individual strands of less than about 10 tex are difficult to process under normal production conditions.

Coagulation of the extruded strands may be carried out in a number of ways, but it is preferred that each strand is extruded downwardly through a nozzle, and allowed to fall under gravity through an air gap into a bath of coagulant solution, where it is eventually received on a slowly moving mesh belt. The use of an air gap prevents the problems caused by entry of coagulant into the nozzle, causing premature coagulation.

Collecting the strands on a mesh belt enables them to be handled whilst in the coagulant bath and then withdrawn from it without any other handling operation which might damage them. It also facilitates transfer of the strands to the next process step in which the residual processing chemicals are removed. This latter may be effected by using at least one solvent liquid, or by using heat to volatilise the organic material. One example of a solvent extraction process is described in detail in U.S. Pat. No. 3,738,805 and a heat extraction process is described in U.S. Pat. No. 3,452,532.

In either system, it is advantageous to thoroughly wash and de-water the strands, thereby removing excess coagulant as far as is practicable before the extraction step. Conveniently, hot air could also be used for this purpose.

After solvent extraction, the strands should be dried, preferably allowing them to retain a fairly small moisture content to help reduce dust formation in the twisting operation. Where heat extraction is employed, the desired small moisture content may be provided by "conditioning" the strands; that is, by subjecting them to a moistening process. This is very important where the extraction is carried out by heating, because the strand will have a very low moisture content after extraction.

Hitherto, the twisting of medium weight dispersion-based yarns has generally required the use of flyer frames or pot spinning in order to deal with the relatively large water content of the unextracted strand, because the mass of the wet strand usually causes excessive ballooning on ring frames. However, the dry strands which can be produced according to the present invention are light in weight and can readily be twisted on a ring frame, using a rather lower twist factor than for a wet strand. The lower twist appears to help in producing a bulky yarn which gives good "cover" when processed into fabric.

The invention also includes both yarns and never-twisted strands produced by a process according to the invention and textile products made from such yarns or strands.

In order that the invention be better understood, two preferred embodiments of it will now be described by way of example with reference to the accompanying drawings in which FIG. 1 is a schematic diagram of part of a dispersion-based asbestos yarn production unit.

Figure 2:
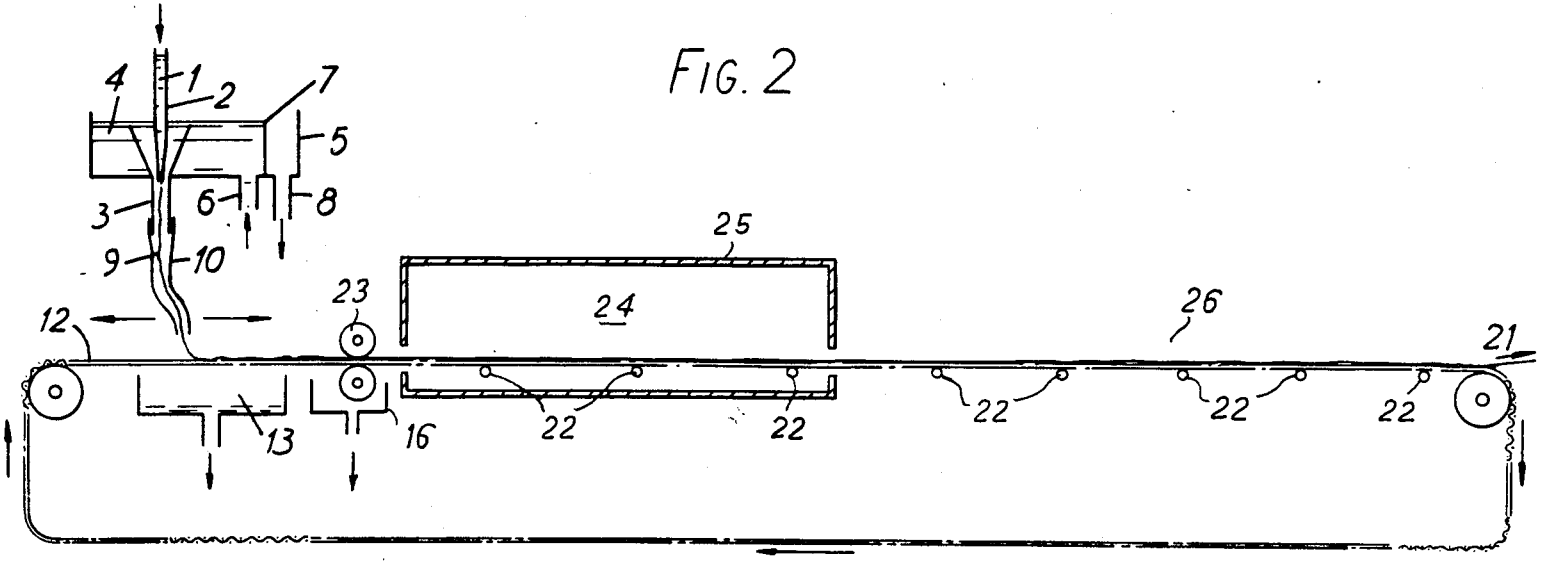

FIG. 2 is a schematic diagram of the same production unit as in FIG. 1, but using heat extraction instead of solvent extraction to remove residual processing chemicals from the strand. As far as practicable the same reference numerals are used in both figures.

In the diagram, asbestos dispersion 1 flows down a nozzle 2 into a funnel 3 through which coagulant liquid 4 flows, the funnel being part of a constant head box unit 5. Coagulant is pumped into the unit 5 through a pipe 6 and escapes either through the funnel 3 or over a weir 7, the latter returning the coagulant through pipe 8 for recirculation.

Dispersion emerging from the nozzle 2 into the coagulant from the funnel into a short, flexible tube 10, the free end 11 of which is traversed with a generally circular motion to deposit the strand and coagulant stream onto a moving endless wire mesh belt 12. Surplus coagulant falls through the belt into a tank 13, from which it can be recirculated or recovered. The belt carrying the strand then passes under a water spray generated by a first "rainbox" 14, the excess liquid being removed by a first roller nip 15 and the surplus wash liquor plus coagulant is collected in a tank 16.

The washed and de-watered strand is then carried by the belt under spray nozzles 17 which spray a solvent system onto the strand, surplus/spent solvent plus residual processing chemicals from the strand being collected in tank 18. A second roller nip 15 assists in removing liquid from the strand prior to its passage under a second rainbox 14 which sprays wash water onto the strand. Excess wash liquid is then removed by a third roller nip 15 and collected in a tank 19.

The strand is then carried through a hot air drying chamber 20 and finally collected off the end of the belt at 21. The "dry" strand contains less than 20% by weight of water, the precise water content being adjustable by changing the drying air temperature and/or the speed of the belt. The dry strand may be reeled or even twisted into a yarn directly from the belt.

A plurality of strands can be extruded on to a single belt and processed together prior to twisting into a single yarn.

In FIG. 2, the strand deposited on the belt 12 is dewatered by a roller nip 23 and the surplus liquor collected by means of a tank 16. The strand then enters a heating zone 24 inside a chamber 25, where it is exposed to superheated steam which volatises the residual processing chemicals in the strand. From the heating zone, the strand passes through a cooling zone 26, the belt being supported throughout both zones by a plurality of idler rollers 22. After cooling, the strand is taken off the belt at 21 and reeled for further processing, such as twisting into a yarn. Because the heat extraction process tends to yield a strand of minimal water content, a preliminary moistening ("conditioning") treatment may be needed before spinning, simply in order to minimize the production of dust. The strand may however be spun directly from the belt 12 where the moisture content will permit this.

I claim:

1. A process for making a dispersion-based asbestos strand for later twisting to form a yarn, said process comprising the steps of:

a. forming an elongate continuous stream from an aqueous coagulable dispersion comprised of asbestos fibres, water and dispersion-forming chemicals;
b. coagulating said dispersion in said stream to form a self-sustaining asbestos fibre strand containing coagulated dispersion-forming chemicals together with uncoagulated residues thereof and water;
c. whilst said strand is in an untwisted state removing substantially the whole of the coagulated dispersion-forming chemicals and said uncoagulated residues thereof, and
d. adjusting the water content of the strand to provide an untwisted strand formed substantially wholly of said asbestos fibres and containing not more than 20% by weight of water.

2. A process according to claim 1 including the further step of washing the self-sustaining strand prior to the step of removing the coagulated dispersion-forming chemicals and the uncoagulated residues thereof.

3. A process according to claim 1 including the further step of removing excess liquid from the self-sustaining strand prior to the step of removing the coagulated dispersion-forming chemicals and uncoagulated residues thereof.

4. A process according to claim 1 including the further step of twisting the strand into a yarn after adjusting the water content thereof.

5. A process according to claim 1 wherein at least two self-sustaining strands are formed, together with the further step of twisting said strands together into a single yarn following the step of adjusting the water content thereof.

6. A process according to claim 1 wherein the coagulated dispersion forming chemicals, uncoagulated residues thereof and water are removed by heating the strand.

7. A process according to claim 1 wherein the coagulated dispersion-forming chemicals and uncoagulated residues thereof are removed by treating the strand with at least one solvent liquid.

8. A never-twisted asbestos strand made by a process according to claim 1.

9. The method of making asbestos yarn which comprises the step of a. providing an aqueous dispersion of asbestos fibres in dispersion-forming chemicals;

b. forming at least one elongate continuous stream of said dispersion and contacting said stream with a coagulant for said dispersion to form at least one self-sustaining wet strand of asbestos fibres and coagulated dispersion-forming chemicals together with uncoagulated residues thereof and water;

c. extracting substantially all of said coagulated dispersion forming chemicals and uncoagulated residues thereof from the wet strand;

d. adjusting the water content of the wet strand to provide an essentially dry strand having a moisture content of not more than 20% by weight allowing the twisting of said dry strand on a spinning frame, and e. twisting said essentially dry strand to provide said asbestos yarn.

* * * * *